US005483432A

United States Patent [19]

Wang

[11] Patent Number: 5,483,432

[45] Date of Patent: Jan. 9, 1996

[54] POLE-MOUNTED PARK LIGHT FIXTURE

[76] Inventor: Fong-Yi Wang, 17, Alley 10, Young Te Lane, Wen Sen Li, Hsinpu, Hsinchu Shien, Taiwan

[21] Appl. No.: 280,495

[22] Filed: Jul. 26, 1994

[51] Int. Cl.[6] ..... F21S 13/10; F21V 3/00

[52] U.S. Cl. ..... 362/431; 362/363; 362/410; 362/226; 362/438; 362/439; 362/414

[58] Field of Search ..... 362/431, 226, 362/410, 414, 363, 438, 439, 437, 433, 153, 153.1, 359, 311, 360

[56] References Cited

U.S. PATENT DOCUMENTS

| | | | |
|---|---|---|---|
| 2,764,670 | 9/1956 | Van Dusen, Jr. | 362/431 X |
| 4,499,527 | 2/1985 | Tauber et al. | 362/267 X |
| 5,055,987 | 10/1991 | Ellson et al. | 362/431 X |
| 5,297,013 | 3/1994 | Hall et al. | 362/363 |
| 5,398,180 | 3/1995 | Lee | 362/431 |

*Primary Examiner*—Ira S. Lazarus
*Assistant Examiner*—Thomas M. Sember
*Attorney, Agent, or Firm*—Morton I. Rosenberg; David I. Klein

[57] ABSTRACT

A pole-mounted park light fixture is provided, The light fixture includes the utilization of a soft sleeve in the form of a unitary structure that can be directly mounted onto a pole situation in the ground, A light bulb is installed into the upper end of the soft sleeve, The soft sleeve has a pair of diverging attachment strips extending outward from the upper end thereof for fastening a lamp hood thereto, Electrical wires extend through recesses formed in opposing sides of a wall surface of an opening formed in an opening disposed in the lower end of the soft sleeve, The opening in the lower end of the soft sleeve is provided to receive the pole therein.

1 Claim, 5 Drawing Sheets

POLE-MOUNTED PARK LIGHT FIXTURE

BACKGROUND OF THE INVENTION

At certain outdoor sites, people utilize light fixtures hung on extended arrays, which in specially designated areas constitutes an effective means of illumination. For example, such lighting fixtures may be utilized to form the shape of characters or positioned so as to line both of sides of paths through public parks to serve as directional markers and so on that evoke varying degrees of aesthetic emotion. Conventional methods involve the prior insertion into the ground of small poles and then the direct mounting of the light fixtures onto the small poles, a task that is quite troublesome, difficult to stabilize, easily loosened, and thus impractical in terms of overall outcome. Furthermore, although the installation is outdoors, the conventional methods lack a means of water-resistance, which rather easily leads to the occurrence of hazardous short circuits.

Therefore, the primary objective of the invention herein is to provide a kind of improved structure light fixture that can be stably installed that is, furthermore, effectively water-resistant and safe, the unique structural features of which are elaborated in the drawings and detailed description below.

DETAILED DESCRIPTION OF THE INVENTION

Figure 1:
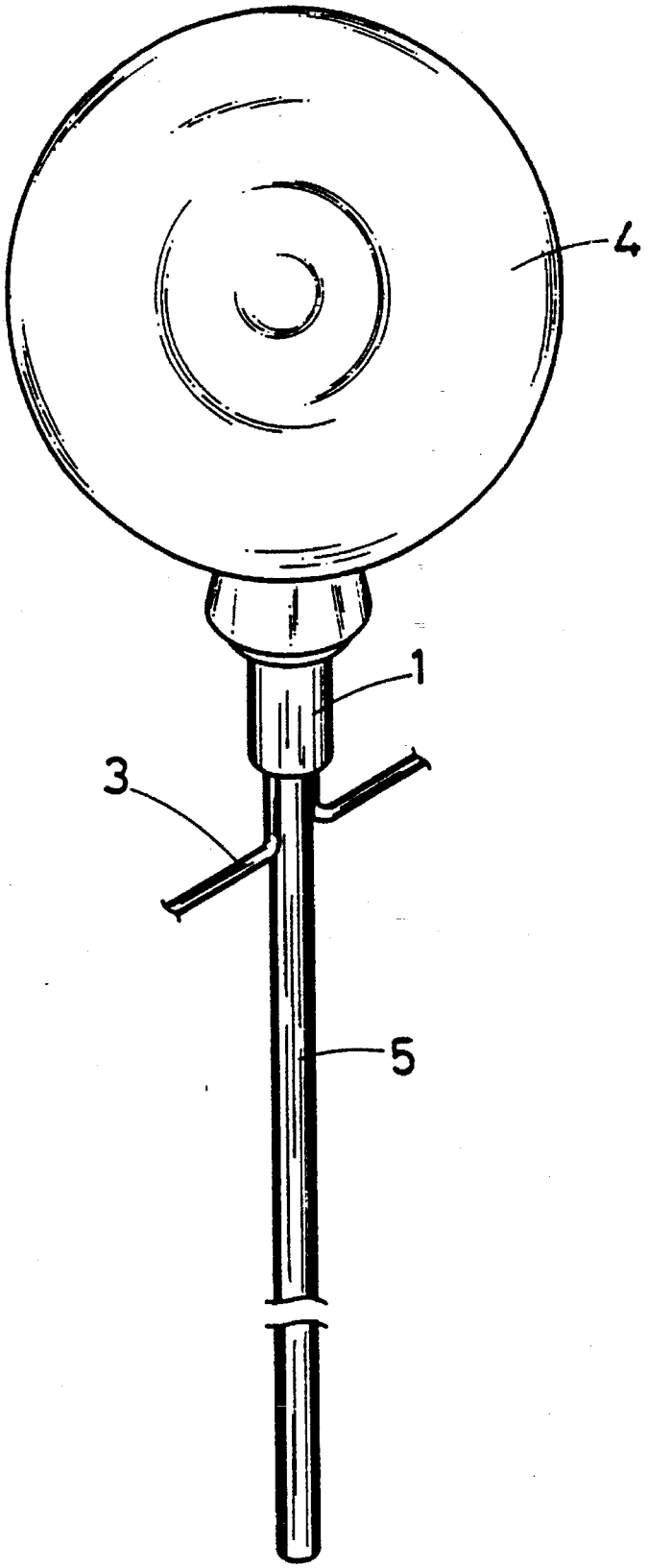
FIG. 1 is an isometric drawing of the assembled invention herein.
Figure 2:
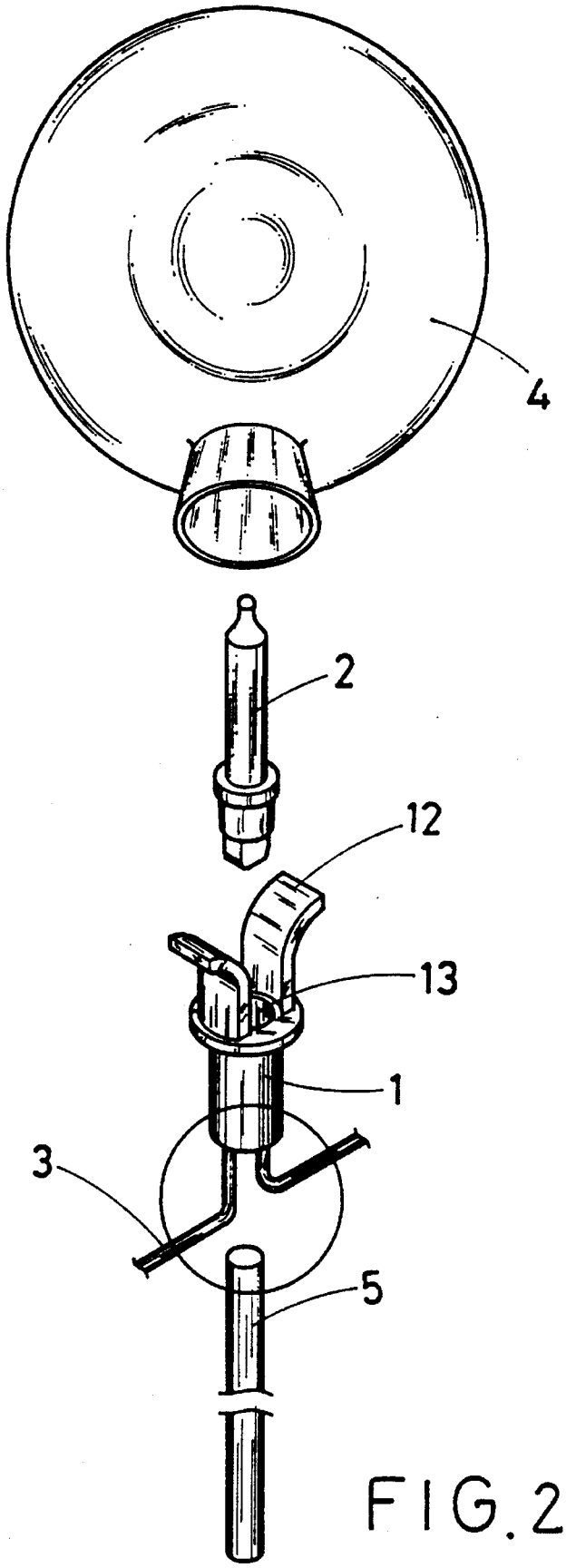
FIG. 2 is an isometric exploded drawing of the invention herein.
Figure 3:
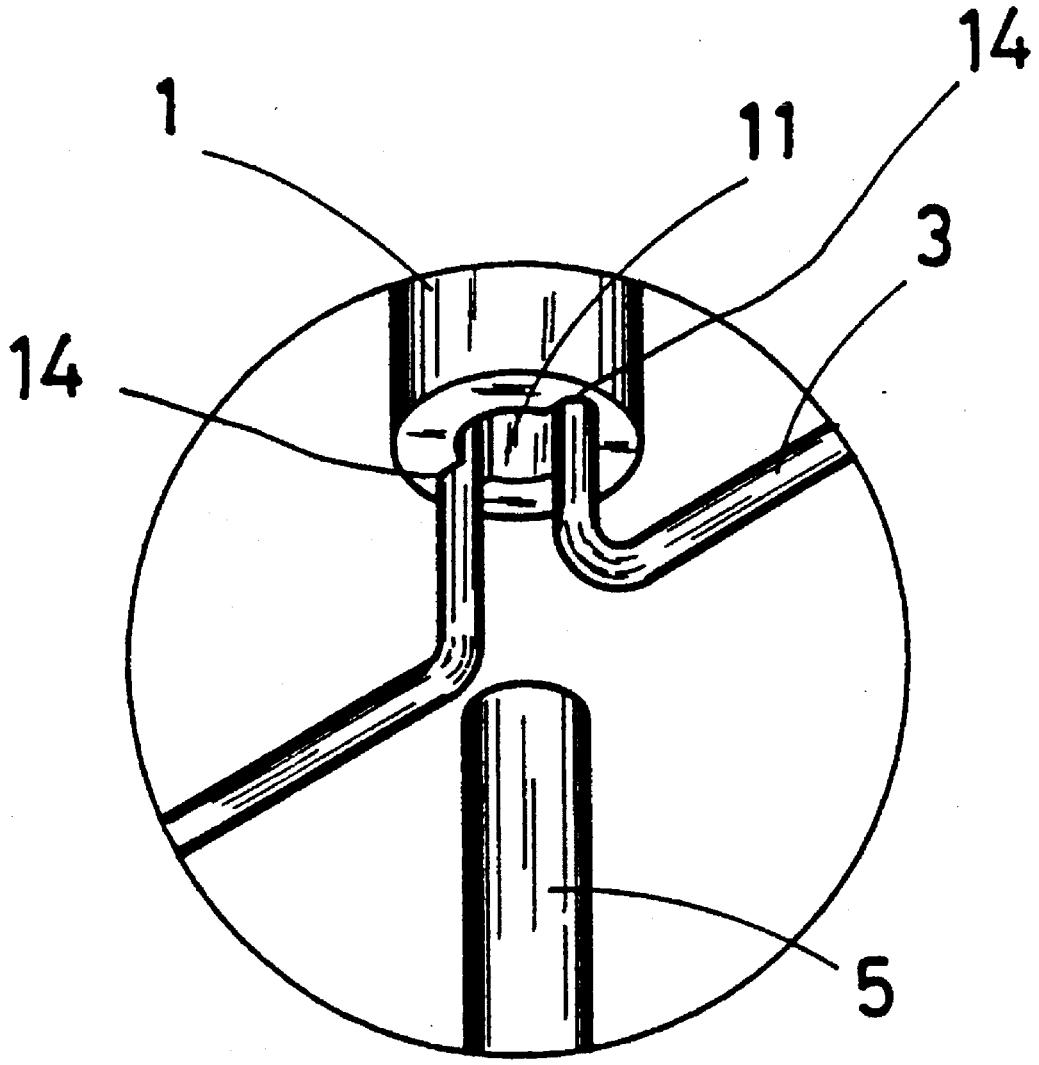
FIG. 3 is a partial isometric drawing of the invention herein in a partial magnified view.
Figure 4:
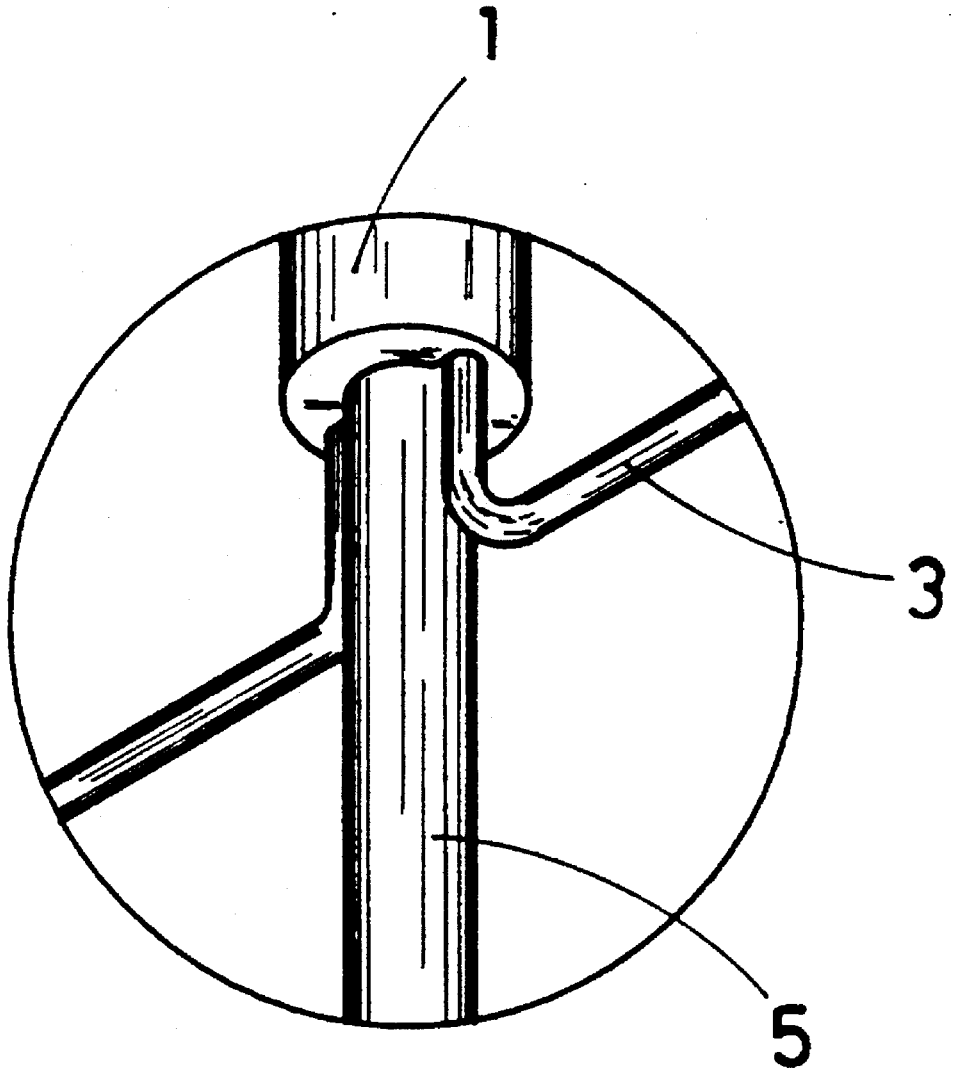
FIG. 4 is a isometric drawing of the invention herein depicting the partial magnified view of the FIG. 3 when assembled.
Figure 5:
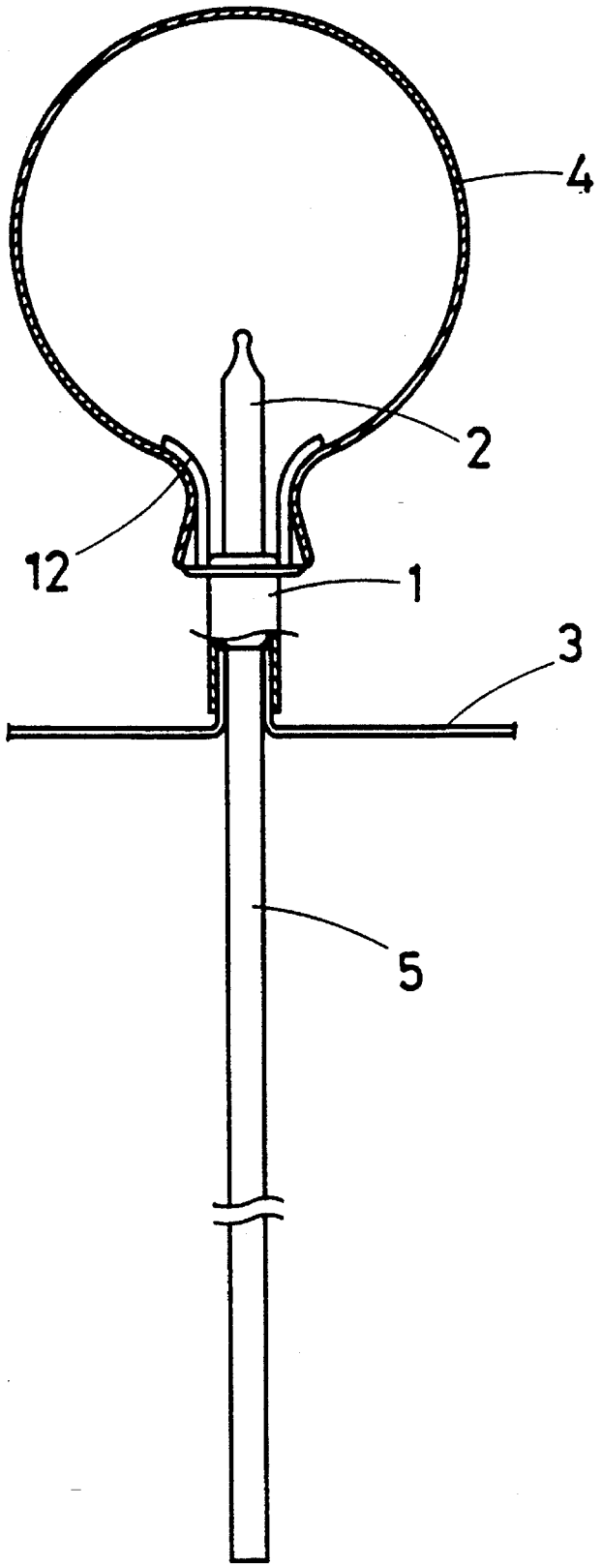
FIG. 5 is a cross-sectional drawing of the invention herein.

As indicated in the drawings, the invention herein mainly includes the utilization of a soft sleeve (1) that serves as a connecting component of unitary construction having an open hole (11) at the lower end and diverging attachment strips (12) extending from the upper end, a light bulb (2) that is installed into the center hole (13) through the upper end of the sleeve (1) and electric power wires (3) inserted into a pair of longitudinally extended recessed 14 formed in opposing wall surfaces of the open hole (11) from the lower end of the sleeve (1) which is in conductive contact with the light bulb (2). A lamp hood (4) is slipped over the upper end of the socket (1) and is securely fastened in position by the elasticity of the two diverging attachment strips (12).

During utilization, each light bulb (2) and lamp hood (4) fixture of the invention herein is mounted by inserting a small pole (5) through the open hole (11) at the lower end of the sleeve (1), wherein each illuminated light bulb assemblage can be simply and rapidly mounted on small poles (5) that have first been placed into position in a prearranged configuration and pattern which, furthermore, provides a means of mounting that is not easily dislodged. Furthermore, due to the protective function of the lamp hood (4), the design of the invention herein achieves an effective degree of water resistance, thereby enhancing the practical value of the invention herein.

In summation of the foregoing description, the invention herein is of an innovative structure that ensures simple installation and, furthermore, practical safety and durability in usage, thereby complying with new patent requirements and the granting of patent fights, for which the invention herein is duly submitted in application as prescribed by law.

What is claimed is:

1. A pole-mounted park light fixture, comprising:

a pole having opposing first and second ends, said first end being secured to a base surface; and a lamp assembly releasably coupled to said second end of said pole, said lamp assembly including:

a. a light bulb;

b. a lamp hood for enclosing said light bulb;

c. a soft sleeve having opposing longitudinally spaced upper and lower ends, said upper end having a first opening centrally formed therein for receiving said light bulb therein, said upper end having a pair of elastic diverging strip-like projections extending therefrom for elastically retaining said lamp hood thereto, said lower end of said soft sleeve having a second opening formed centrally therein for receiving said second end of said pole therein, said lower end having a pair of longitudinally extended recesses formed in opposing wall surfaces of said second opening and in open communication therewith, each of said pair of recesses being in open communication with said first opening; and, d. a pair of conductive wires respectively disposed in said pair of recesses for electrical coupling with said light bulb.

* * * * *